US008065963B2

(12) United States Patent
Groels

(10) Patent No.: US 8,065,963 B2
(45) Date of Patent: Nov. 29, 2011

(54) FAIRGROUND ATTRACTION HAVING PEOPLE CARRIERS DRIFTINGLY MOVABLE ALONG A TRACK

(75) Inventor: Hendrikus Maria Petro Johannes Helena Groels, Valkenswaard (NL)

(73) Assignee: K.I.G. Heerenveen B.V., Terband (NL)

( * ) Notice: Subject to any disclaimer, the term of this patent is extended or adjusted under 35 U.S.C. 154(b) by 0 days.

(21) Appl. No.: 11/883,050

(22) PCT Filed: Jan. 26, 2006

(86) PCT No.: PCT/NL2006/000047

§ 371 (c)(1),
(2), (4) Date: May 21, 2008

(87) PCT Pub. No.: WO2006/080845

PCT Pub. Date: Aug. 3, 2006

(65) Prior Publication Data

US 2009/0013896 A1 Jan. 15, 2009

(30) Foreign Application Priority Data

Jan. 26, 2005 (NL) ..... 1028118

(51) Int. Cl.
*A63G 21/04* (2006.01)
*A63G 21/08* (2006.01)

(52) U.S. Cl. ..... 104/75

(58) Field of Classification Search ..... 104/53, 104/74, 75
See application file for complete search history.

(56) References Cited

U.S. PATENT DOCUMENTS

| | | | | |
|---|---|---|---|---|
| 3,554,130 | A | 1/1971 | Broggie et al. | |
| 3,774,543 | A * | 11/1973 | Welsh | 104/130.07 |
| 4,920,890 | A | 5/1990 | Barber | |
| 5,115,744 | A * | 5/1992 | Barber | 104/75 |
| 5,453,053 | A | 9/1995 | Danta et al. | |
| 5,456,184 | A * | 10/1995 | Fritz | 104/139 |
| 6,523,479 | B1 * | 2/2003 | Schilke et al. | 104/57 |
| 2006/0178221 | A1 * | 8/2006 | Threlkel | 472/1 |

FOREIGN PATENT DOCUMENTS

| | | |
|---|---|---|
| DE | 198 35 236 | 2/2000 |
| NL | 9400847 | 1/1996 |

* cited by examiner

*Primary Examiner* — Joe Morano, IV
*Assistant Examiner* — Zachary Kuhfuss
(74) *Attorney, Agent, or Firm* — Harness, Dickey & Pierce, P.L.C.

(57) ABSTRACT

A fairground attraction is disclosed, including a track, a number of people carriers and device connected to the people carriers for advancing thereof along the track. Each people carrier is connected to the advancing device for pivoting about its top axis and is suspended in cantilevered manner above the track or rests thereon via support devices displaceable at an angle to the direction of forward movement. The people carriers can thus be moved as it were in "drifting" manner over the track. The advancing device can be arranged between the track and the people carriers, and can include for each people carrier a connecting member which protrudes from the track and on which the people carrier is mounted on its centre line and around which the people carrier can swivel. The fairground attraction can further be provided with devices for forcing the people carriers back to a neutral position oriented along the track and/or means for placing the people carriers at an angle relative to the direction of forward movement.

13 Claims, 3 Drawing Sheets

FAIRGROUND ATTRACTION HAVING PEOPLE CARRIERS DRIFTINGLY MOVABLE ALONG A TRACK

The invention relates to a fairground attraction, comprising a track, at least one people carrier and means connected to the at least one people carrier for advancing thereof along the track. Such an attraction is known in different variants.

An example of such an attraction can be found in U.S. Pat. No. 4,920,890. The fairground attraction described here comprises a track over which a number of cars can travel. The vehicles are cross-country vehicles built to scale which can seat one person at a time. The cars are each provided with an electric motor which is powered from a current-carrying conductor in a channel in the track via a pick-up element on the underside of the vehicle. Because the pick-up element protrudes into the channel, the cars are forced to follow the track. In order to be able to negotiate bends here, the front wheels of the cars take a steerable form.

Another attraction of this type is described in U.S. Pat. No. 3,410,223. This attraction forms a racetrack over which two cars can travel next to each other. The cars are each held on the track by a holding element, which is arranged in one of two parallel channels in the track. In order to enable some movement relative to the channels a connecting rod pivotable about two bearings is arranged between each car and the associated holding element.

The invention now has for its object to provide a fairground attraction of the above described type which provides a greater perception of speed and more sensation than the known attractions. According to the invention this is achieved in such an attraction in that the at least one people carrier is connected to the advancing means for pivoting about its top axis and is suspended in cantilevered manner above the track or rests thereon via support means displaceable at an angle to the direction of forward movement. The people carrier can hereby perform swivelling movements transversely of its direction of forward movement, thereby creating the suggestion of skidding or drifting in the manner of an oversteered vehicle.

Preferred embodiments of the fairground attraction according to the invention are described in the dependent claims.

Figures 1, 2:
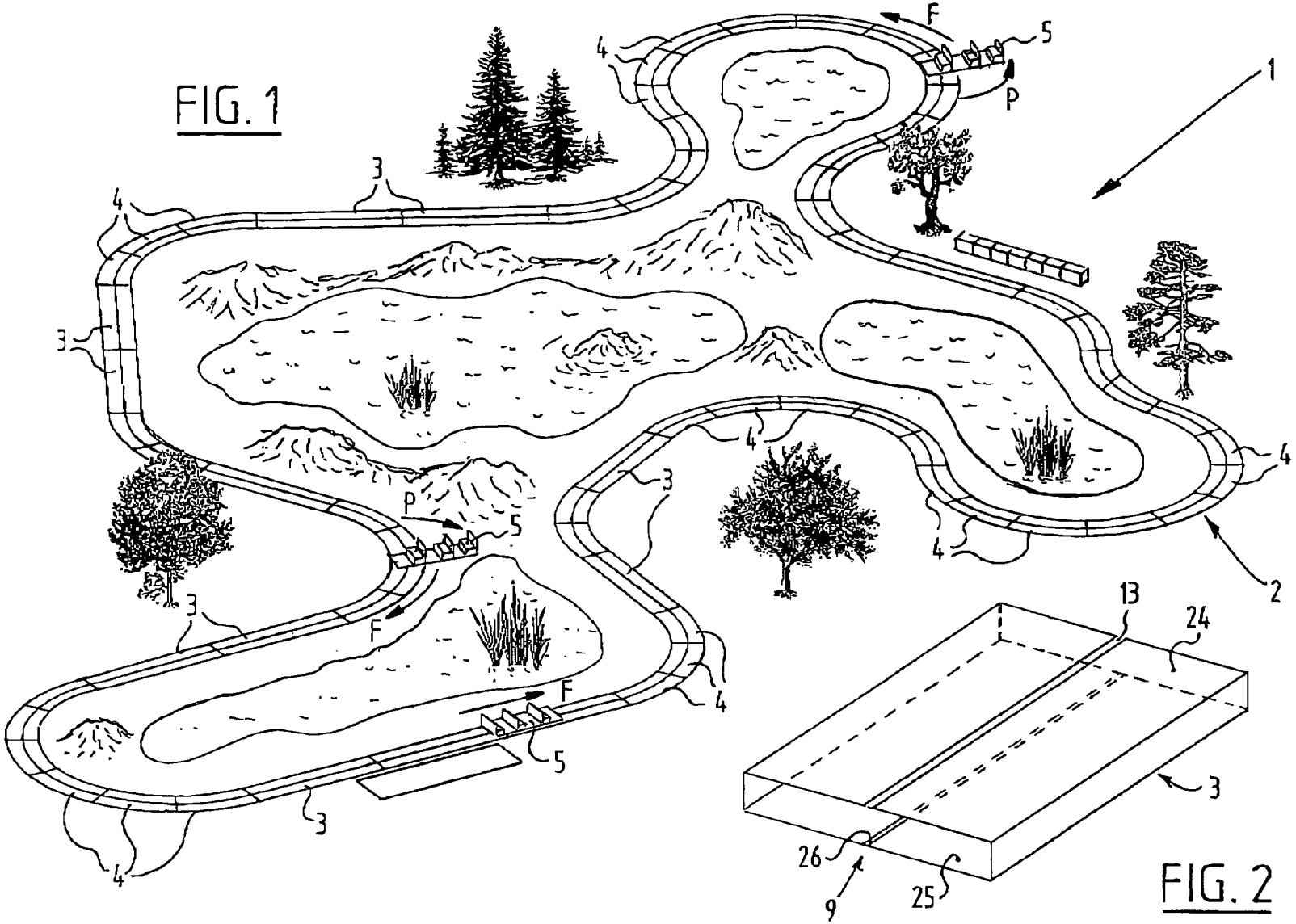
Figure 5:
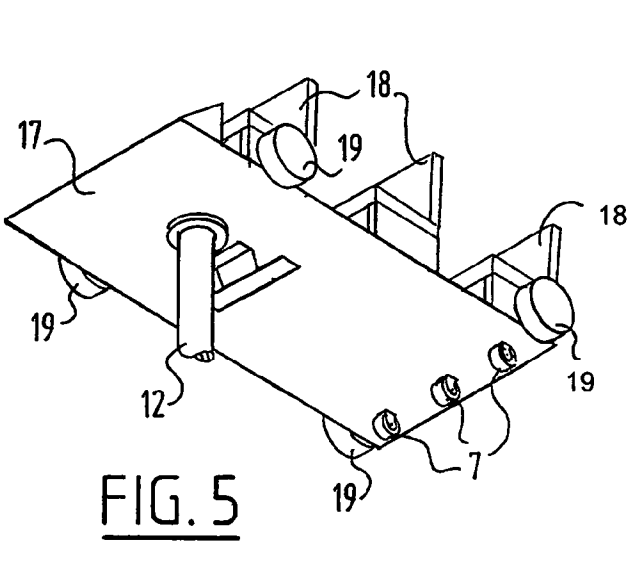
Figure 3:
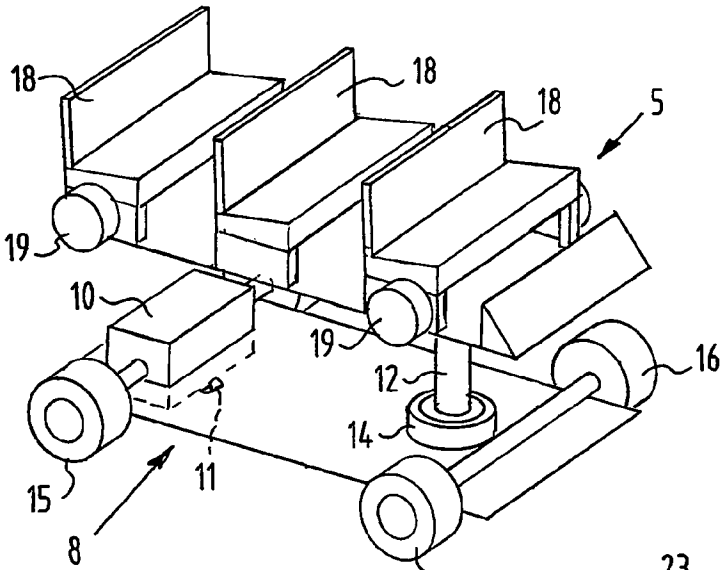
Figure 4:
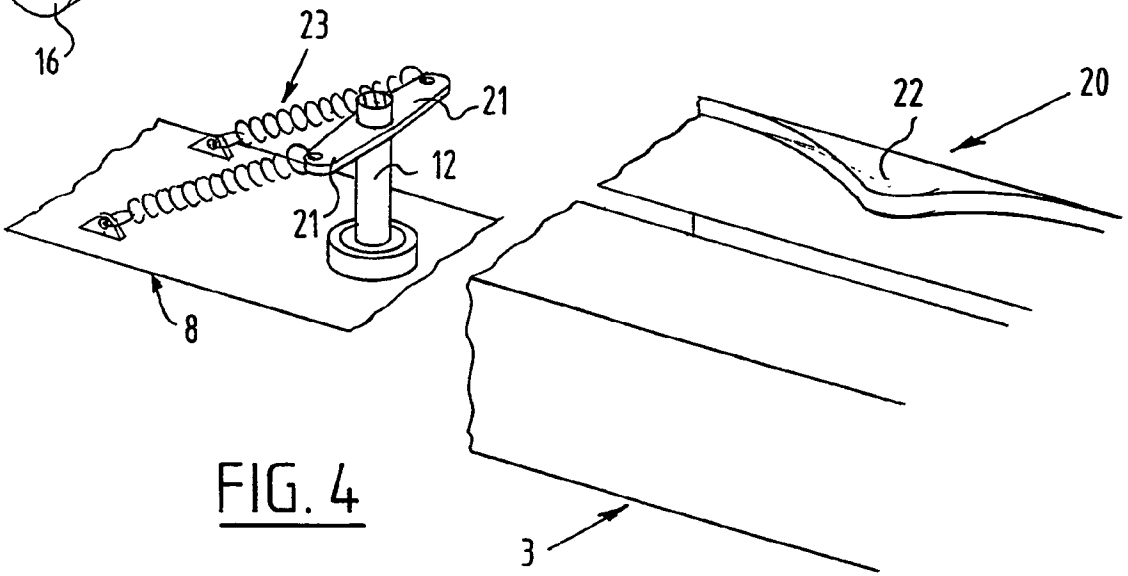
Figure 6:
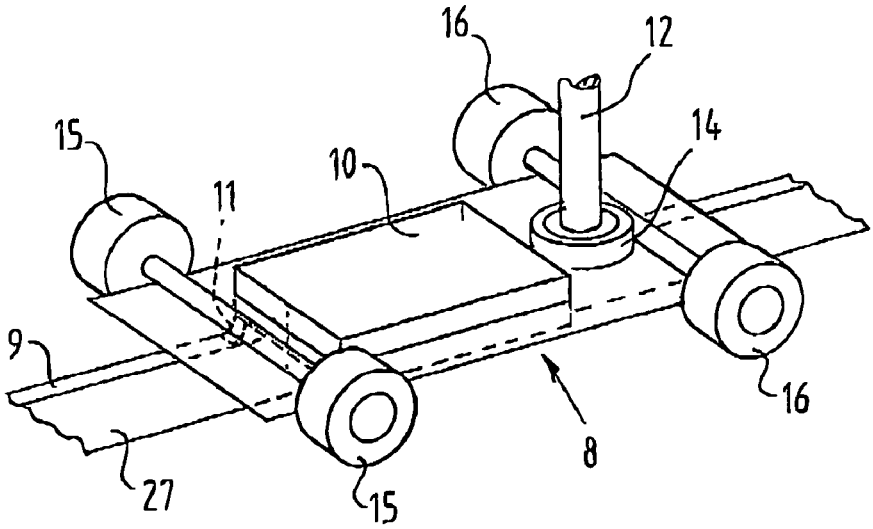

The invention will now be elucidated on the basis of a number of embodiments, wherein reference is made to the accompanying drawing, in which:

FIG. 1 shows a schematic perspective view of the fairground attraction according to the invention, FIG. 2 shows a straight segment of the track of the attraction of FIG. 1, FIG. 3 is a schematic perspective view of a people carrier applied in the attraction of FIG. 1, FIG. 4 shows a variant of the people carrier with means for adjustment thereof to a determined angle, FIG. 5 is a perspective bottom view of yet another variant of the people carrier, and FIG. 6 shows a schematic perspective view of a variant of the people carrier and a part of the track co-acting therewith.

A fairground attraction 1 (FIG. 1) comprises a track 2 which is constructed from a number of straight track segments 3 and curved track segments 4 which are releasably connected to each other. Track 2 can have any desired course by combining these segments 3, 4, which can have a limited number of standard shapes. Movable over track 2 are people carriers 5 which are advanced in the direction of arrow F along track 2 by advancing means 6 specially adapted for this purpose. Each people carrier 5 is connected to advancing means 6 for pivoting about its top axis, and is suspended in cantilevered manner above track 2 or rests thereon via swivel wheels 7 (FIG. 5) or other support means displaceable at an angle to the direction of forward movement. Due to these provisions people carrier 5 can perform swivelling movements as according to arrow P transversely of the direction F in which it is being advanced, thereby evoking the suggestion that people carrier 5 is skidding or drifting through a bend. In the shown embodiment the area surrounding track 2 is further decorated with trees, ponds, rock masses, bales of straw and the like, which give the impression that people carrier 5 is moving over a rally course.

In the shown embodiment advancing means 6 comprise for each people carrier 5 a carriage or slide 8 (FIG. 3) which is enclosed under track 2 and displaceable along a conductor 9 (FIG. 2) situated under track 2. This conductor 9 is current-carrying and carriage 8 has an electric motor 10 for driving thereof which is connected to conductor 9 via a sliding contact 11 on the underside.

Mounted on carriage 8 is an upright connecting member 12 which protrudes out of track 2 through a channel 13 and is attached to the underside of people carrier 5 roughly on the centre line thereof. In the shown embodiment this connecting member 12 is arranged pivotally in a bearing 14.

Carriage 8 has in the shown embodiment two rear wheels 15 and two front wheels 16. Rear wheels 15 are driven by electric motor 10, optionally via a transmission. Front wheels 16 are free-running wheels which serve particularly for the stability of the assembly of carriage 8 and people carrier 5. When people carrier 5 is moved at great speed through a bend there is after all the danger of tilting due to the centre of gravity lying high above carriage 8. In this respect the width of carriage 8, or in particular the track width of the front and rear wheels 15, 16, is also of the same order of magnitude as the width of people carrier 5.

In an alternative embodiment the electric motor 10 of carriage 8 is a linear induction motor (FIG. 6). This is a type of motor where, compared to a conventional electric motor, the stator and rotor are as it were "rolled out". The stator is powered with an alternating current and thus generates a moving magnetic field. When a conductor (comparable to the rotor) is situated in this moving magnetic field, eddy currents are induced therein which in turn generate a magnetic field in opposite direction. The oppositely directed magnetic fields of the stator and the conductor repel each other, whereby the stator and the conductor are driven apart. When the conductor is fixed, the stator is thus displaced thereby.

The linear induction motor 10 does not therefore drive the wheels 15 of carriage 8 here but reacts as it were against a conductor or induction strip 27 under track 2. Wear is hereby limited compared to the first embodiment, while in addition the construction of carriage 8 is simplified because all wheels 15, 16 can be embodied as free-running wheels, and drive elements, transmissions and the like are unnecessary. Induction strip 27, which can be manufactured from an efficiently conducting material such as copper or aluminium, can be arranged adjacently of the current-carrying conductor 9 for power supply to the linear induction motor 10.

People carrier 5 is formed by a bottom plate 17 on which three seats 18 are arranged for transporting for instance six or nine passengers (FIG. 3). Further arranged on the side of people carrier 5 are wheels 19, although these are intended only to enhance the suggestion of a travelling vehicle. Wheels 19 are dimensioned such that they remain clear of track 2 under all conditions, so that people carrier 5 can swivel freely. People carrier 5 can however, as stated, be provided with swivel wheels 7 which rest on track 2. The construction of people carrier 5 can hereby be lighter than if it is given a wholly cantilevered form. In order to prevent people carrier 5 tilting when one of the swivel wheels 7 passes over channel 13, three swivel wheels 7 are provided in the shown embodiment, two of which are always resting on track 2.

Through a suitable placing of connecting member 12 relative to the centre of gravity of people carrier 5 it is possible in principle to ensure that in each bend people carrier 5 performs a movement in transverse direction under the influence of the centrifugal force. In order to enhance the sensation it may be desirable to also generate a movement in transverse direction on the straight track segments 3. The attraction 1 can be provided for this purpose with means 20 for placing people carrier 5 at an angle relative to its direction of forward movement F. These angle adjusting means 20 can take the form of two protruding arms 21 on connecting member 12 which co-act with obstacles 22 placed along track 2 (FIG. 4). The angle adjusting means 20 are therefore then passive, although obstacles 22 could be displaced or exchanged in order to simulate skidding at other locations.

It is also possible to envisage giving these angle adjusting means 20 an active form, for instance by replacing the fixed arms 21 by hydraulic jacks which can be extended in order to cause people carrier 5 to swivel about connecting member 12. A gear rim on the connecting member to be driven by an electric motor is of course also a possibility. The control of these active angle adjusting means 20 could be provided centrally, either manually by staff operating the attraction 1 or automatically by a suitably programmed control device. It is even possible to envisage a control being provided in people carrier 5, although this can of course result in disagreement in the case of multiple passengers.

In order to prevent people carrier 5 taking up extreme angles to the direction of forward movement F, whereby the free space around track 2 would have to be very large, means 23 can be provided for forcing people carrier 5 back to a neutral position oriented along track 2. These forcing-back means 23 can be given a passive form, and simply take the form of one or more springs (FIG. 4), but could also be given an active embodiment in the form once again of hydraulic jacks or the above mentioned gear rim. Dampers could also be present to bound the movements of people carrier 5.

As stated, track 2 is assembled from segments 3, 4 connected releasably to each other. In the shown embodiment each segment has a box-like form, with an upper surface 24 defining the actual track 2 and a lower surface 25 on which (a segment 26 of) conductor 9 is arranged (FIG. 2). Segments 26 of conductor 9 can be conductively connected to each other so that a continuous circuit is formed under the whole track 2, although it is also possible to envisage a part of these segments 25 being connected individually to a power source. In this case the power supply can be varied so that for instance at the beginning of a straight part of track 2 the power supply to electric motor 10 is increased in order to accelerate people carrier 5, while at the end of a straight part this power supply is reduced so as to cause the people carrier 5 to slow down slightly before a bend.

Although the invention is elucidated above on the basis of a number of possible embodiments, it will be apparent that it is not limited thereto, but can be varied in many ways within the scope of the following claims.

The invention claimed is:

1. A fairground attraction system, comprising:

a track under which there is arranged a conductor, the track including straight segments and curved segments defining bends, the segments being connected to form a closed loop, at least one people carrier, and an advancing device connected to the at least one people carrier for advancing thereof along the track, the advancing device includes at least one driven carriage or slide displaceable along the conductor, wherein the at least one people carrier is connected to the advancing device for pivoting about its top axis and is suspended in a cantilevered manner above the track or rests thereon via a supporting device displaceable at an angle to the direction of forward movement, wherein the at least one driven carriage or slide of the advancing device is arranged between the track and the at least one people carrier, and further includes a connecting member which protrudes from the track and on which the at least one people carrier is mounted substantially on its center line and around which the at least one people carrier can swivel, wherein the connecting member is placed near a front of the at least one people carrier in respect to in the direction of forward movement, such that in each bend of the track, the at least one people carrier performs a movement in a transverse direction under influence of centrifugal force, and wherein the conductor is current-carrying and the at least one driven carriage or slide is driven electrically, the conductor including a number of segments and the power supply being adjustable per conductor segment so as to accelerate the at least one people carrier at the beginning of a straight track segment and slow down the at least one people carrier before a bend.

2. A fairground attraction system as claimed in claim 1, wherein the at least one people carrier includes a bottom plate and seats arranged thereon, and wherein the supporting device includes swivel wheels arranged under the bottom plate.

3. The fairground attraction system as claimed in claim 1, further including a forcing-back device for forcing the at least one people carrier back to a neutral position oriented along the track, the forcing-back device including one of (i) at least one spring, (ii) hydraulic jacks or (iii) a motor driven gear rim.

4. The fairground attraction system as claimed in claim 1, further comprising an angle adjusting device for placing the at least one people carrier at an angle relative to its direction of forward movement.

5. The fairground attraction system as claimed in claim 4, wherein the angle adjusting device comprises at least one obstacle arranged along the track and co-acting with a part of the at least one people carrier.

6. The fairground attraction system as claimed in claim 4, wherein the angle adjusting device comprises at least one controllable steering member arranged between the at least one people carrier and the advancing device or between the at least one people carrier and the track.

7. The fairground attraction system as claimed in claim 1, wherein the at least one driven carriage or slide is enclosed under the track.

8. The fairground attraction system as claimed in claim 7, wherein a channel is formed in the track, through which the channel protrudes the connecting member carried by the at least one driven carriage or slide, and the at least one driven carriage or slide protrudes on either side outside of the channel.

9. The fairground attraction system as claimed in claim 8, wherein width of the at least one driven carriage or slide is substantially equal to the width of the at least one people carrier.

10. The fairground attraction system as claimed in claim 1, wherein the at least one driven carriage or slide is provided with a linear induction motor wherein an induction strip is arranged adjacently of the conductor.

11. The fairground attraction system as claimed in claim 1, wherein a conductor segment and an induction strip are arranged in each track segment.

12. The fairground attraction system as claimed in claim 1, wherein the supporting device comprises swivel wheels.

13. The fairground attraction system as claimed in claim 1, wherein the at least one people carrier has at least three swivel wheels arranged transversely in its direction of forward movement.

* * * * *